United States Patent [19]

Samuelson et al.

[11] 3,944,463

[45] Mar. 16, 1976

[54] PULPING OF LIGNOCELLULOSIC MATERIAL WITH OXYGEN IN TWO STAGES AT INCREASING PH

[75] Inventors: Hans Olof Samuelson, Goteborg; Leif Ake Smedman, Domsjoverken; Erik Olof Sture Hagglund, Ornskoldsvik, all of Sweden

[73] Assignee: Mo och Domsjo Aktiebolag, Ornskoldsvik, Sweden

[22] Filed: Dec. 12, 1973

[21] Appl. No.: 424,148

[30] Foreign Application Priority Data

Dec. 19, 1972 Sweden ..... 16651/72

[52] U.S. Cl. ..... 162/65; 8/111; 162/78; 162/90

[51] Int. Cl.[2] ..... D21C 3/26

[58] Field of Search ..... 162/65, 78, 90; 8/111

[56] References Cited

UNITED STATES PATENTS

| | | | |
|---|---|---|---|
| 2,147,618 | 2/1939 | Rawling | 162/65 |
| 2,673,148 | 3/1954 | Harris | 162/65 |
| 2,926,114 | 2/1960 | Grangaard et al. | 162/65 X |
| 3,024,158 | 3/1962 | Grangaard et al. | 162/65 X |
| 3,251,730 | 5/1966 | Watanabe | 162/65 X |
| 3,764,464 | 10/1973 | Samuelson | 162/65 |
| 3,769,152 | 10/1973 | Samuelson et al. | 162/65 |

FOREIGN PATENTS OR APPLICATIONS

| | | | |
|---|---|---|---|
| 694,720 | 9/1964 | Canada | 162/65 |
| 2,040,763 | 11/1971 | Germany | 162/65 |

*Primary Examiner*—S. Leon Bashore
*Assistant Examiner*—Arthur L. Corbin

[57] ABSTRACT

A process is provided for producing cellulose pulp of high brightness, which comprises pulping lignocellulosic material such as wood with oxygen under superatmospheric pressure in two stages, in the first at a pH within the range from about 6 to about 9, and in the second at a more alkaline pH of at least about 10.

28 Claims, No Drawings

PULPING OF LIGNOCELLULOSIC MATERIAL WITH OXYGEN IN TWO STAGES AT INCREASING PH

It is known that cellulosic material can be digested by treatment with oxygen in an alkaline medium in order to prepare chemical and semichemical cellulose pulp. The oxygen treatment is carried out at an elevated temperature, of the order of 100° to 170°C, and normally at high oxygen pressures. The amount of active alkali required is of the order of 4 to 40%, based on the dry pulp, and calculated as NaOH. It is possible to digest cellulose in this way, but unfortunately, at the same time a significant decomposition of the cellulose takes place, as evidenced by a lower viscosity value, and a darker color of the treated pulp. It is also difficult to control the uniformity of the digestion.

Harris U.S. Pat. No. 2,673,148, dated Mar. 23, 1954, proposed an oxygen digestion process for cellulosic material using quite high oxygen pressures, of the order of at least 800 psi. This was thought necessary in order to obtain and maintain a sufficiently high oxygen concentration in the digestion liquor. However, under these conditions, the process is uneconomical.

Grangaard and Saunders, U.S. Pat. No. 2,926,114, dated Feb. 23, 1960, stated that oxygen prior to 1957 has been used both at low and at high oxygen pressures. However, at low pressures, the pulping was inadequate, and the process had to be used only as a single stage in a multiple stage pulping process, using more conventional pulping chemicals to complete the pulping. At the high pressures, the pressures are so high that large volume batch digesters cannot be readily constructed to withstand them. Grangaard et. al. proposed a digestion at pH 7 to 9 over at least a major portion of the cooking time, ranging up to 9.4 at the end of the cook, under oxygen pressures of 40 to 250 psi, using conventional batch digesters. The pH is maintained within the desired range by a buffer such as sodium bicarbonate, or by continuous addition of alkali such as sodium hydroxide or sodium carbonate, to neutralize free acids formed throughout the digestion. However, the disadvantages are an extremely high oxygen consumption; it is difficult to control the process; and a nonuniform pulp is obtained. There is, moreover, a high consumption of sodium bicarbonate, and no method is suggested for the recovery of bicarbonate.

The Grangaard et al. patent illustrates the difficulties in developing a practical pulping process using oxygen. Indeed, in a recent investigation of the oxygen digestion process by J. C. Lescot, "Essais de delignification de bois feuillus par l'oxygene en milieu alcalin" (Ph. D. Thesis, Univ. of Grenoble, France, Oct. 27, 1967), the conclusion was reached that alkaline oxygen digestion was not feasible, due to the difficulties of impregnation. The author reported that a pre-digestion with other chemicals was necessary, before the delignification with oxygen and alkali.

Oxygen and alkali have also been used in the delignification of cellulose pulp prepared by digestion of the cellulose using other pulping methods, such as the sulfate or sulfite pulping methods. However, while the delignification proceeds well, in removing lignin from the pulp, at the same time hemicellulose is dissolved, and a significant decomposition of the cellulose takes place, as in oxygen-alkali pulping, as evidenced by a lower viscosity value of the delignified sulfate or cellulose pulp.

It has been proposed in U.S. Pat. No. 3,384,533 dated May 21, 1968, to Robert et al that the oxygen-alkali delignification process be improved by inhibiting degradation of the cellulose, carrying out the treatment in the presence of a degradation inhibitor, a metal carbonate, such as barium carbonate, calcium carbonate, magnesium carbonate or zinc carbonate, in an amount within the range from about 0.5 to 3% by weight of the pulp. Of these chemicals, magnesium carbonate gives the best results, when in an amount of approximately 1% by weight of the pulp. However, magnesium carbonate is quite expensive, and the treatment is costly. Calcium carbonate, which is cheaper, is much less effective. In the case of all of these salts, the difficulty is that a powdered water-insoluble inhibitor must be charged to and mixed with the aqueous cellulose pulp system, and it is accordingly hard to obtain and maintain a homogeneous mixture, with uniform inhibiting effect.

Noreus and Samuelson U.S. Pat. No. 3,652,386 patented Mar. 28, 1972 describe a process for the reduction of lignin content in cellulose pulp without causing deleterious degradation of the cellulose. Complex magnesium salts, such as chelates of magnesium and aliphatic alpha-and beta-hydroxycarboxylic acids, are incorporated into the alkaline oxygen delignification solution, to reduce attack of oxygen on the hemicellulose and cellulose carbohydrates without appreciably diminishing the oxidation of the lignin and its dissolution in the course of the process. This process seeks to control the degradation of the cellulosic material after liberation by the delignification solution by addition of degradation inhibitors.

Noreus and Samuelson U.S. Pat. No. 3,652,385, patented Mar. 28, 1972, propose a modification of the delignification process of U.S. Pat. No. 3,652,386 by pretreating the cellulosic material so as to remove or inactivate metal ions by way of acids or complexing agents. In a further modification, the alkali is added in increments or continuously, so that alkali is added in at least one additional stage during the oxygen treatment, in addition to the amount of alkali present at the beginning of the treatment. Transition metals or metal compounds catalyze the attack on the cellulose or hemicellulose, and their removal or inactivation decreases the degradation of the carbohydrates. This process also relies on degradation inhibitors to lessen degradation of the cellulose during the digestion or delignification.

Samuelson and Noreus, Ser. No. 19,375, filed Feb. 26, 1971 now U.S. Pat. No. 3,769,152, patented Oct. 30, 1973, provide a process for the alkaline oxygen digestion of wood which can be controlled by removal of carbon dioxide, so as to inhibit formation of slivers or shives, as well as to prevent undue degradation, thereby to increase the uniformity of the cellulose pulp, and improve its color and strength properties. In this process, the alkaline digestion liquor comprises alkali metal bicarbonate or carbonate, or both, oxygen gas is provided under pressure to the reaction system, and carbon dioxide that is formed and enters the oxygen phase during the digestion process is separated at least once during the digestion, and preferably either continuously, or from time to time, so as to maintain a high partial pressure of oxygen in the gas phase. The carbon dioxide that is separated can be recovered and used to form alkali metal carbonate, or bicarbonate, or both, and recycled, and since the resulting process is more efficient, this results in greater economy both of alkali and of oxygen.

Unfortunately, when wood is pulped by use of a carbonate such as sodium bicarbonate at a pH within the range from about 7 to about 9, it becomes difficult to control the pulping so as to keep the proportion of slivers or shives at a minimum. The proportion of shives is reduced at higher pHs, within the range from about 9 to about 13, utilizing sodium hydroxide or sodium carbonate, but even under these conditions the proportion of shives produced by the pulping is undesirably high unless the pulping time is rather long, and if the time be long the degradation of carbohydrates increases, with the result that the properties of the pulp make it unsatisfactory for most paper applications.

In accordance with the instant invention, it has been determined that it is possible to produce a pulp having a substantially higher brightness than pulps obtained by other known methods, and also, optionally, a low proportion of shives, and high strength properties, if the pulping of the lignocellulosic material with oxygen is carried out in two stages, the first stage being conducted at a pH within the range from about 6 to about 9, and the second stage being conducted at a pH of at least about 10.

The process of the invention accordingly produces cellulose pulp having a high brightness, and comprises pulping lignocellulosic material, and particularly wood, with oxygen under superatmospheric pressure in the presence of an alkaline compound in at least two oxygen pulping stages, in a first stage at a pH within the range from about 6 to about 9 and at a temperature within the range from about 110° to about 160°C, and in a second stage at a pH of at least about 10, and preferably within the range from about 11 to about 12, and at a temperature within the range from about 80° to about 160°C, and continuing the pulping with oxygen under superatmospheric pressure at a temperature within the range from about 80° to about 160°C until cellulose pulp having a high brightness is obtained.

The alkaline compound is selected to allow pulping with oxygen at a pH within the stated range. The alkaline compound can be selected from the group consisting of alkali metal and alkaline earth metal carbonates, bicarbonates, and hydroxides, and mixtures thereof, with the alkali metal carbonates, bicarbonates, and hydroxides being preferred, and sodium carbonate, sodium bicarbonate, sodium hydroxide, and mixtures thereof being particularly preferred. Other exemplary alkaline compounds are potassium hydroxide, potassium carbonate, calcium hydroxide, calcium carbonate, lithium carbonate, strontium hydroxide, strontium carbonate, barium hydroxide and barium carbonate.

The total amount of alkali that is required for the pulping with oxygen and alkali in the process of the invention is determined by the quality and type of the pulp to be produced, and is within the range from about 1 to about 10 kilomoles per 1000 kg. of dry lignocellulosic material. It is well known that certain types of pulp are more pulped than others. This is entirely conventional, and does not form a part of the instant invention.

Cellulose pulps intended to be used in the production of regenerated cellulose fibers, such as viscose, acetate and cuprammonium pulps, are quite fully pulped and should have a low content of lignin and hemicellulose. In the production of such pulps, in accordance with the process of the invention, the amount of alkali can be within the range from about 6 to about 8 kilomoles per 1000 kg. of dry wood.

Semichemical pulps are given an intensive mechanical treatment following the pulping, in order to liberate the cellulose fibers, and in the production of such pulps, using the process of the invention, the amount of alkali can be much less, within the range from about 1 to about 2 kilomoles per 1000 kg. of dry wood.

For the production of bright paper pulp, which is readily defibered when the digester is blown, the amount of alkali used in the process of the invention can be within the range from about 2.5 to about 5 kilomoles.

Generally, for most of the types of pulps given an intermediate degree of pulping, such as pulps for fine paper, plastic fillers, and soft paper or tissue paper, the amount of alkali in the process of the invention is within the range from about 2 to about 6 kilomoles per 1000 kg. of dry wood.

It is also possible to add the additional chemicals normally present in pulping liquors, such as sodium sulfate, as well as small amounts of sodium sulfide or other alkali metal sulfide. At most, such chemicals are added in an amount of about 1 kilomole per 1000 kg. of dry lignocellulosic material.

All of the alkali required for the pulping can be added to the cellulosic material such as wood to be pulped at the start of the process. It is also possible to add only a portion of the alkali required at the start of the process and to add alkali to the system thereafter, either incrementally or continuously. It may be convenient in order to maintain the pH within the desired range to measure the pH continuously or from time to time, and to add alkali to the system in amounts such that the desired pH can be maintained.

Limiting the amount of alkali in the initial stages of the oxygen pulping can be advantageous in obtaining a cellulose pulp of the desired quality. It is suitable to add at most 75% of the total molar quantity required of the alkali ab initio, and even this high percentage is only desirable if the pulp to be manufactured is a semichemical pulp, or if the lignocellulosic material such as wood had been pretreated with sulfur dioxide in aqueous solution. For most pulps, including even the semichemical pulps, a better cellulose pulp is obtained if the initial charge of alkali is within the range from about 2 to about 50% of the total molar quantity required for the pulping. The remainder of the alkali is added progressively, either incrementally or continuously, as the pulping continues. When producing bright pulps having a low lignin content, it is satisfactory to charge not more than 20% and suitably from about 5 to about 20% of the alkali at the beginning of the process.

If a mixture of alkali metal hydroxide and alkali metal carbonate is used, it is particularly suitable if the initial charge comprises sodium carbonate, optionally with an addition of sodium bicarbonate as described above, the remainder of the alkali added as the process proceeds being sodium hydroxide. If the alkali charge is initially alkalli metal hydroxide, it is usually important in producing pulps having a low lignin content that the initial charge be low, within the range from about 2 to about 10%, of the total molar quality of alkali.

The pH of the pulping liquor is determined by selecting samples of pulping liquor, immediately cooling them to room temperature in a cooler connected to the digester and then measuring the pH of the sample at room temperature. It is important to measure pH under these conditions, since the pH values obtained at the superatmospheric pressure and temperature prevailing in the pulping vessel may differ from the pH values obtained under these conditions. The pH cannot be determined with accuracy by the devices now available under the pulping pressure and temperature conditions.

The process of the invention makes it possible to prepare cellulose pulps of varying proportions of hemicellulose, as may be desired, by controlling the pH, temperature, and time of pulping in each of the two pH stages, so as to obtain a final pulp having an optimum proportion of hemicellulose for the intended use. The process makes it possible to produce both low and high hemicellulose pulps, low hemicellulose pulps being especially suitable for the manufacture of rayon and cellulose derivatives. Since the pulping process utilizes oxygen and not sulfur compounds, it is nonpolluting, and the byproducts and residual liquors can be processed and recycled without difficulty.

The oxygen-alkali pulping process of the invention is applicable to any kind of lignocellulosic material, such as bagasse, plant material, and especially wood. In general, hardwood such as beech and oak can be pulped more easily than softwood, such as spruce and pine, but both types of wood can be pulped satisfactorily using this process. Exemplary hardwoods which can be pulped include birch, beech, poplar, cherry, sycamore, hickory, ash, oak, chestnut, aspen, maple, alder and eucalyptus. Exemplary softwoods include spruce, fir, pine, cedar, juniper and hemlock.

In the case of softwood, the processing conditions, including the particle size of the wood fragments, the pulping temperature, the alkali concentration, and the oxygen pressure, should be carefully determined and controlled during the pulping.

The material should be in particulate form. Wood chips having dimensions that are conventionally employed in the sulfate process can be used. However, appreciable advantages with respect to uniformity of the pulping process under all kinds of reaction conditions within the stated ranges can be obtained if the wood is in the form of nonuniform fragments of the type of wood shavings or chips having an average thickness of at most 3 mm., and preferably within the range from about 0.2 to about 2 mm. Other dimensions are not critical. Sawdust, wood flour, wood slivers and splinters, wood granules, and wood chunks, and other types of wood fragments can also be used. It is important, particularly in the case of softwood, that the wood fragments be thin, since otherwise the pulping may be nonuniform, and the process may be more difficult to control.

The oxygen pulping process of the invention is advantageously preceded by a pretreatment in which the lignocellulosic material such as wood is treated with an aqueous liquor containing an alkaline compound as defined above, at a temperature within the range from about 60° to about 200° C, preferably from about 100° to about 180° C, and most preferably from about 120° to about 160° C. This pretreatment should be so carried out that from about 1 to about 30%, preferably from about 3 to about 25%, and most preferably from about 5 to about 15% of the lignocellulosic material, based on the dry weight of the material, is dissolved in the pretreatment liquor. It is preferred to maintain the pH of the pretreatment liquor within the range from about 6.5 to about 14, preferably from about 7 to about 9, during the major portion of the pretreatment time.

The pretreating liquor preferably contains sodium carbonate, sodium bicarbonate or a mixture thereof, as the alkaline compound, and water or a spent pulping, bleaching or pretreating liquor as the aqueous phase. The pretreating liquor can be prepared by adding sodium carbonate and/or sodium bicarbonate to the water or waste liquor. These sodium compounds may be recovered from waste products from the process by combustion of such waste liquors. It is also possible to prepare the pretreating liquor utilizing sodium hydroxide, which may be readily available, particularly in cases where it is intended to produce cellulose pulps having a low hemicellulose content. If a waste pretreating liquor suitable for combustion is to be obtained, the pretreating liquor should contain or be prepared from waste liquor derived from the oxygen pulping process.

To obtain an optimum pulping effect in the first stage of the oxygen pulping process of the invention, the spent pretreating liquor should be separated from the lignocellulosic material before the oxygen pulping is begun. This can be done by washing out the spent pretreating liquor, either partially or entirely, from the pretreated lignocellulosic material, utilizing for the purpose water or a waste oxygen pulping liquor derived from the oxygen pulping process, preferably from the first oxygen pulping stage of the process in accordance with the invention.

The properties of the cellulosic pulp obtained in the pulping process of the invention are especially influenced by the pH value of the pulping liquor in the first oxygen pulping stage. A satisfactory low formation of shives and low degradation of the cellulose molecule are obtained if the pH is within the range from about 6 to about 9. A shorter pulping time during the first stage can be used if the pH is within the higher portion of the range. Low-viscosity pulp can be produced utilizing an oxygen pulping liquor within the entire pH range of from about 6 to about 9. If it is desirable when producing such pulps to obtain a short reaction time during the first stage, and at the same time the most complete utilization possible of the active alkali supply, it is possible to operate the first oxygen pulping step at a pH of about 9 for the major portion, and then allow the pH to decrease toward the lower end of the range during the remainder of the pulping time in this stage. When high viscosity pulps are to be produced, appreciably better results are obtained if the pH in the first stage is kept within the range from about 6.5 to 8, preferably from about 7 to about 8, during most of the pulping time in this stage.

The oxygen pulping liquor used in the first pulping stage preferably contains sodium bicarbonate as the alkaline compound. The sodium bicarbonate can be supplied as such to the first pulping stage, but instead of sodium bicarbonate it is possible to supply a blend of sodium carbonate and/or bicarbonate plus sodium hydroxide. When carbonate or bicarbonate is used, carbon dioxide is liberated, and this, upon addition of sodium carbonate or sodium hydroxide, dissolves in the pulping liquor to form bicarbonate ion.

Whether bicarbonate, carbonate, or hydroxide, or a mixture thereof is supplied as the alkaline compound, it is suitable to add the alkaline compound incrementally during this stage. Advantageously, the addition is controlled to maintain the pH within the range from about 6 to about 9.

During the first oxygen pulping stage, the partial pressure of oxygen may be maintained within the range from about 3 to about 200 bars. A lower oxygen partial pressure results in formation of a high proportion of shives, and in a low viscosity pulp, in particular when wood chips are used as the raw material, while a higher oxygen pressure increases the cost of the pulping without a commensurately reduced pulping time.

To produce paper pulps, it is preferable to conduct the first oxygen pulping stage at an oxygen pressure within the range from about 8 to about 50 bars, preferably from about 10 to about 25 bars. Generally, an oxygen pressure within the range from about 20 to about 25 bars is sufficient to produce a pulp intended for very high strength papers, while a pressure of about 10 bars is quite sufficient to produce dissolving pulps and other pulps which do not require high strength. When using softwood as the raw lignocellulosic material, it is suitable to use a higher oxygen pressure than in the case of hardwood to obtain a pulp having a low proportion of shives.

Since the oxygen that is employed as an essential component in the pulping process of the invention is a gas, the socalled gas phase pulping procedure can be used to advantage. In this case the lignocellulosic material and the film of liquor present on the lignocellulosic material are kept in continuous contact with the oxygen-containing gas. If the lignocellulosic material is completely or substantially immersed in the liquor, it is important to agitate the lignocellulosic material and/or the gas and/or atomize the gas or the liquor. The oxygen should be dissolved or dispersed in the liquor to the greatest extent possible. Dissolution or dispersion of the oxygen in the liquor can take place within the vessel and/or externally of the same, such as in nozzles, containers, or other known devices used for dissolving or dispersing gases in liquids.

Transfer of oxygen to the lignocellulosic material impregnated with liquor is important in the process, and is controlled by adjusting the oxygen pressure, the temperature and/or the proportion of gas-liquid contact surfaces, including lignocellulosic material impregnated with liquor.

The oxygen is preferably employed as pure oxygen, but mixtures of oxygen with other inert gases can be used, such as, for example, mixtures of oxygen with nitrogen, as well as air. Mixtures with carbon dioxide are formed in the course of the process.

The temperature in the first oxygen pulping stage is maintained within the range from about 110° to about 160°C, preferably from about 120° to about 150°C, and still more preferably from about 130° to about 145°C.

At higher temperatures, a shorter time is required. A pulping time of from about 15 to about 60 minutes can suffice at the higher temperatures, while from about 60 to 300 minutes may be needed at the lower temperatures.

Carbon dioxide is normally evolved in the course of the first oxygen pulping stage. A high proportion of carbon dioxide retards the delignification, and uncontrolled variations in the carbon dioxide content of the pulping liquor make control of the pulping process difficult. Therefore, it is appropriate to separate carbon dioxide from the gaseous phase during the first oxygen pulping stage, either continuously or from time to time. This can be done in various ways.

The atmosphere over the pulping liquor can, for example, be circulated to a carbon dioxide absorber, where the carbon dioxide content thereof is absorbed in an alkaline liquid, after which the residual gases, primarily containing oxygen, may be recycled to the pulping. To prepare the carbon dioxide absorption liquid, it is possible to use, for example, sodium carbonate recovered by combustion of concentrated waste pulping liquor, or an aqueous solution obtained by wet combustion of waste pulping liquors. The spent absorption liquid may suitably be used in the first oxygen pulping stage, and also in the pretreatment stage of the process of the invention.

The increase in pH of the pulping liquor for the second oxygen pulping stage can be effected in various ways, of which the following three ways are exemplary:

1. removing the first pulping liquor (from the first stage), optionally washing the partially pulped cellulosic material, and then adding a second pulping liquor having a pH of at least about 10.

2. retaining the first pulping liquor, and adding sufficient alkali to the spent liquor to adjust the pH to at least about 10.

3. removing carbon dioxide from the spent pulping liquor from the first stage.

The second stage pulping liquor can have a similar composition to the first, except that the alkali and its amount are selected to obtain a pH of at least about 10. For this purpose, the second pulping liquor suitably contains sodium carbonate and/or sodium hydroxide as the active alkaline compound. In the second pulping stage, as also in the first pulping stage, it is advantageous to add alkaline compound in the course of the pulping, to replace active alkali that is consumed, and to maintain the pH of the pulping liquor within the desired range of at least about 10. Such addition can be batchwise, in one or more steps, or continuously.

The first pulping liquor also can be retained, and the pH increased by removing carbon dioxide. This can be done by blowing, or by withdrawing the atmosphere of oxygen and carbon dioxide, until enough carbon dioxide has been released to increase the pH to above 10. Sparging the liquor with oxygen or inert gas or a mixture thereof such as air can also be used.

The temperature in the second oxygen pulping stage is maintained within the range from about 80° to about 160°C, preferably from about 90° to about 140°C, and still more preferably from about 100° to about 125°C. At the higher temperatures, a shorter time is required for the second oxygen pulping stage, so that a pulping time of from about 15 to about 60 minutes can be satisfactory, while at the lower temperatures the reaction time should be within the range from about 60 to about 300 minutes.

If it is desired to avoid a marked viscosity reduction in the cellulose pulp in this stage, the temperature should be below 140°C and preferably from about 100° to about 125°C.

The partial pressure of oxygen during the second oxygen pulping stage may be lower than in the first, and can be within the range from about 1 to about 100 bars, preferably from about 3 to about 20 bars, and most preferably from 5 to about 12 bars.

In the course of the second oxygen pulping stage, in particular during the final portion thereof, the pH may be allowed to fall below 10, such as for example to a pH of about 9.

In order to obtain a low proportion of shives in the cellulose pulp, it is preferable to remove the first stage pulping liquor, wash the partially pulped cellulosic material from the first oxygen pulping stage, and then add a second pulping liquor for the second oxygen pulping stage. As the washing liquor, it has been found advantageous with regard to the quality of the pulp as well as to the recovery of the chemicals to use as the washing liquor a spent pulping liquor from the second oxygen pulping stage in accordance with the invention.

When it is desired to produce cellulose pulp having a high degree of polymerization, i.e. a low degree of degradation, it is suitable to carry out the pulping in the presence of a degradation inhibitor or mixture of inhibitors, which also protect the cellulose and hemicellulose molecules against uncontrolled degradation. The effect is reflected by the viscosity of the pulp, and the degree of polymerization of the cellulose.

The inhibitors can to advantage be charged to the pulping liquor during an early stage of the pulping, preferably at the beginning, before the heating is begun. Thus, they can be added to the liquor before combination with lignocellulosic material or shortly thereafter. They can also be added to the pretreatment liquor, if this is not separated from the pulp prior to the oxygen-alkali pulping.

Suitable inhibitors are water-insoluble magnesium compounds, such as magnesium carbonate. Magnesium carbonate is known, and is disclosed in U.S. Pat. No. 3,384,533 to Robert et al. dated May 21, 1968 as useful in the delignification and bleaching of cellulose pulps with alkali and oxygen. Other water-insoluble magnesium compounds such as magnesium oxide and hydroxide are disclosed in U.S. Pat. No. 3,657,065 to Smith et al. dated Apr. 18, 1972, as useful in the alkaline oxygen bleaching of cellulose pulps. Also useful are water-soluble magnesium compounds such as magnesium chloride or magnesium acetate. These are also disclosed in U.S. Pat. No. 3,657,065. Magnesium compounds which are soluble in the liquor in the course of the process such as water-soluble complex magnesium compounds can also be used. Exemplary are the water-soluble complex magnesium compounds disclosed in the U.S. Pat. Nos. 3,652,385 and 3,652,386 to Noreus and Samuelson, and U.S. Ser. No. 119,375, filed Feb. 26, 1971 to Samuelson and Noreus, now U.S. Pat. No. 3,769,152 patented Oct. 30, 1973.

It is particularly advantageous to use magnesium compounds which are entirely soluble in the pulping liquor throughout the pH range of from about 6 to about 9 in the first oxygen pulping stage. On the other hand, in the course of the second oxygen pulping stage, it is advantageous that a small quantity of insoluble magnesium compound, such as for example, magnesium hydroxide, be precipitated in the pulping liquor. Suitable magnesium compounds are magnesium carbonate, magnesium oxide, and magnesium hydroxide, which advantageously are wholly or partially dissolved in waste liquor from either of the two oxygen pulping stages, and then blended with the pulping liquor and lignocellulosic material.

Experiments have demonstrated that addition of magnesium compound to the pulping liquor is particularly advantageous in the second oxygen pulping stage, and therefore it is most suitable to add a magnesium compound in this stage.

The amount of magnesium compound should be within the range from about 0.5 to about 10 grams, calculated as MgO per kilogram of dry wood. The amount includes both dissolved and precipitated magnesium compounds.

To obtain an efficient impregnation of the lignocellulosic material with the inhibitor, it is usually advantageous to add the inhibitor in the course of the first oxygen pulping stage, preferably in the final stages thereof, or after the first oxygen pulping stage has been completed but before the pH is increased to about 10, at the level desired for the second oxygen pulping stage.

A surface active agent can be added to the liquor, and contributes to a reduction in the resin content of the cellulose pulp produced from the lignocellulosic material. This also surprisingly contributes to a reduction in the lignin content, and a more uniform pulping. The surface active agent is suitably added at the beginning of the process, or during an early stage of the process, and may be present during all or only a part of the process. Cationic, anionic, and nonionic surface active agents and mixtures thereof can be used.

When producing pulps for certain papermaking purposes, it may also be suitable to add peroxides, such as hydrogen peroxide and/or sodium peroxide, during the second oxygen pulping stage and/or upon conclusion of this stage. This considerably increases brightness of the resulting pulp, and is of particular importance when the cellulose pulp is used without a separate bleaching process, to make paper or paperboard of relatively high brightness.

The process in accordance with the invention can be carried out in continuously operating digesters or in equipment for batch digestion. In the latter case, the two oxygen pulping stages may advantageously be carried out in a single digester, but it is also possible upon completion of the first oxygen pulping stage to transfer the partially pulped lignocellulosic material to a different digester unit or pulping zone, where the pulping process is carried to its conclusion. When a pretreatment is included, it is often most suitable to carry out the pretreatment in a separate vessel, of the type, for example, used to carry out prehydrolysis of wood material such as wood chips.

The pulp obtained in accordance with the process of the invention can be bleached using known bleaching agents, such as chlorine, chlorine dioxide, hypochlorite, peroxide and/or oxygen, or combinations of any such bleaching agents, in one or more steps. When producing refined pulps, such as for the manufacture of rayon, the pulp may be purified by treatment with alkali using known methods. The treatment with alkali can also take place in the digester, directly following completion of the pulping.

The recovery of spent liquors from these steps can be integrated in a known manner with the recovery of spent liquors from the oxygen pulping process of the invention. The liquors can be concentrated by evaporation and burned, or subjected directly to wet combustion under an elevated temperature.

The following Examples in the opinion of the inventors represent preferred embodiments of the invention.

EXAMPLE 1

Birch chips having a thickness of approximately 5 mm were steam-treated for 30 minutes and then pretreated with aqueous sodium bicarbonate solution at 160°C for 2 hours. The wood-to-liquor ratio was 1:7 kilograms-to-liters, and the charged amount of sodium bicarbonate was 9% by weight of active alkali, calculated as NaOH, and based on the dry weight of the wood chips. The pretreating liquor was prepared from spent digestion liquor from the first oxygen pulping stage to which sodium bicarbonate was added, and the amount of active alkali was determined by potentiometric titration to pH 7 in boiling aqueous solution. The digester was vented three times in the course of the pretreatment to remove carbon dioxide.

The pretreated wood chips were then washed with spent digestion liquor from the first oxygen pulping stage for 15 minutes, and then subjected to the two-stage oxygen pulping process of the invention.

In both stages, the circulating pulping liquor was sprayed in finely-divided form over the wood chips or partially pulped cellulosic material. In the first pulping stage, the temperature was 140°C, and the oxygen partial pressure was 8 bars. The carbon dioxide pressure was allowed to rise to 0.5 bar, after which the gas from the digester was transferred to an absorber for absorption of carbon dioxide, after which the residual gases were recycled. The wood-to-liquor ratio was 1:14 grams-to-liters, and the time required for the first oxygen pulping stage was 6 hours.

In the course of the pulping, active alkali was charged as sodium bicarbonate-sodium carbonate buffer, which was introduced into spent liquor removed from the oxygen pulping vessel. At the start of this stage, 1.1% by weight of active alkali calculated as NaOH was charged, and in the course of the pulping incrementally an additional 4.8% by weight of alkali was added based on the dry weight of the initial wood chips. In the course of this stage, the pH of the pulping liquor was monitored, and active alkali added to the pulping liquor was metered to maintain a pH within the range from about 7 to about 7.5.

Fifteen minutes before the end of the first pulping stage, 60% of the pulping liquor was withdrawn, and an aqueous solution of magnesium sulfate in pulping liquor containing 50 grams per liter $MgSO_4$ was introduced to the wood chips. The amount of liquor was adjusted so that the total content of magnesium in the pulping liquor, including the amount recycled from a previous pulping, amounted to 1 gram calculated as MgO per liter of pulping liquor.

At the completion of the first pulping stage, the spent pulping liquor was withdrawn, and spent liquor recovered from the second pulping stage was introduced in an amount such that the total quantity of liquor in the digester was 5 liters per kilogram of dry wood. Thereupon, 0.6% by weight of sodium hydroxide based on the dry weight of the wood was introduced, and the pulping in the second stage begun, and continued for 2 hours at 120°C under an oxygen partial pressure of 8 bars. During the first hour of this time, an additional 3.3% of sodium hydroxide was added to maintain the pH value above 10. The pH of the spent liquor was 10.

Following completion of the second pulping stage, the contents of the digester were blown, resulting in defibration. The spent liquor was displaced in a conventional manner with water by countercurrent flow through the chips and recirculated through the process. The pulp that was obtained was screened and analyzed, and the results of two runs carried out under these conditions are compared in Table I, identified as Run A and Run B. For comparison, the Table includes the results of two Control experiments Control 1 and Control 2 wherein another portion of the same chip material was pretreated under identical conditions and subjected to an oxygen pulping in which the second oxygen pulping stage was omitted and the pH value throughout the oxygen pulping maintained at about 8.5.

Table I

| Run No. | Yield: Total pulp % | Yield: Screened pulp % | Kappa number | Intrinsic Viscosity cm³/g | (Residual cellulose after treatment with 5% NaOH) % | Viscosity alkali resistant pulp cm³/g | Brightness % |
|---|---|---|---|---|---|---|---|
| A | 57.2 | 55.5 | 7.7 | 771 | 73.5 | 965 | 66.8 |
| B | 56.2 | 55.0 | 8.0 | 769 | 73.2 | 969 | 66.2 |
| Control 1 | 50.4 | 37.1 | 8.7 | 267 | 73.7 | 333 | 62.3 |
| Control 2 | 49.9 | 35.9 | 7.5 | 259 | 73.8 | 328 | 62.7 |

It is apparent from the above results that Runs A and B gave a pulp of higher brightness in a higher yield, with less degradation of the cellulose and much higher viscosity. There was a substantial reduction in the amount of shives (difference between total and screened yield) compared at the same lignin content (Kappa number) of the screened pulp.

EXAMPLE 2

Birch chips having a thickness of approximately 5 mm were steam-treated for 30 minutes and then pretreated with aqueous sodium bicarbonate solution at 160°C for 2 hours. The wood-to-liquor ratio was 1:5 kilograms-to-liters, and the charged amount of sodium bicarbonate was 9% by weight of active alkali, calculated as NaOH and based on the dry weight of the wood chips. The pretreating liquor was prepared from spent digestion liquor from the first oxygen pulping stage to which sodium bicarbonate was added, and the amount of active alkali was determined by potentiometric titration to pH 7 in boiling aqueous solution. The digester was vented 3 times in the course of the pretreatment to remove carbon dioxide.

The pretreated wood chips were then washed with spent digestion liquor from the first oxygen pulping stage for 15 minutes, and then subjected to the two-stage oxygen pulping process of the invention.

In both stages, the circulating pulping liquor was sprayed in finely-divided form over the wood chips. In the first pulping stage, the temperature was 140°C, and the oxygen partial pressure was 8 bars. The carbon dioxide pressure was allowed to rise to 0.5 bar, after which the gas from the digester was transferred to an absorber for absorption of carbon dioxide, after which the residual gases were recycled. The wood-to-liquor ratio was 1:5 grams-to-liters, and the time required for the first oxygen pulping stage was 5 hours.

In the course of the pulping, active alkali was charged as sodium bicarbonate-sodium carbonate buffer, which was introduced into spent liquor removed from the oxygen pulping vessel. At the start of this stage, 1.1% by weight of active alkali calculated as NaOH was charged, and in the course of the pulping incrementally an additional 4.8% by weight of alkali was added, based on the dry weight of the initial wood chips. In the course of this stage, the pH of the pulping liquor was monitored, and the active alkali added to the pulping liquor was metered to maintain a pH within the range from about 7 to about 7.5.

Fifteen minutes before the end of the first pulping stage, 60% of the pulping liquor was withdrawn, and an aqueous solution of magnesium sulfate in pulping liquor containing 50 grams per liter $MgSO_4$ was introduced to the wood chips. The amount of liquor was adjusted so that the total content of magnesium in the pulping liquor, including the amount recycled from a previous pulping, amounted to 1 gram calculated as MgO per liter of pulping liquor.

At the completion of the first pulping stage, the spent pulping liquor was withdrawn, and spent liquir recovered from the second pulping stage was introduced in an amount such that the total quantity of liquor in the digester was 5 liters per kilogram of dry wood. Thereupon, 0.4% by weight of sodium hydroxide based on the dry weight of the wood was introduced, and the pulping in the second stage begun, and continued for 2 hours at 120°C under an oxygen partial pressure of 8 bars. During the first 45 minutes of this time, an additional 2.6% of sodium hydroxide was added, to maintain the pH value above 10. The pH of the spent liquor was 10.

In addition to the run at 2 hours, runs were also carried out for 1 hour and for 3 hours, during the second oxygen pulping stage.

Following completion of the second pulping stage, the contents of the digester were blown, resulting in defibration. The spent liquor was displaced in a conventional manner with water by countercurrent flow through the chips, and recirculated through the process. The pulp that was obtained was screened and analyzed, and the results of the runs carried out under these conditions are compared in Table II, identified as Runs, C, D, and E.

Table II

| Run No. | Digestion time of second step (hrs.) | Yield Total % | Yield After screening % | Kappa number | Brightness % | Intrinsic viscosity $cm^3/g$ |
|---|---|---|---|---|---|---|
| C | 1 | 62.6 | 49.9 | 17.6 | 52.9 | 730 |
| D | 2 | 61.9 | 53.6 | 12.2 | 60.3 | 720 |
| E | 3 | 60.2 | 54.0 | 10.4 | 61.5 | 720 |

The results in Table II show that during the two-stage oxygen-pulping according to the invention, a substantial reduction in the amount of shives (i.e. difference between total and screened yield), a substantial reduction in lignin content (Kappa number) of the pulp, and a substantial increase in brightness are obtained. Surprisingly, a very moderate and hardly significant reduction in pulp viscosity is obtained. The screening rejects can be recirculated to the oxygen pulping process and thus converted into useful pulp. It is particularly advantageous to recirculate the rejects during the final portion of the first stage or the initial portion of the second stage of the oxygen pulping process.

Having regard to the foregoing disclosure, the following is claimed as the inventive and patentable embodiments thereof:

1. A process for preparing cellulose pulp which comprises pulping lignocellulosic material with oxygen under superatmospheric pressure in the presence of an alkaline compound in at least two oxygen pulping stages, in a first stage at a pH within the range from about 6 to about 9 and at a temperature within the range from about 110° to about 160° C; and in a second stage at a pH of at least about 10 and at a temperature within the range from about 80° to about 160° C; and continuing the pulping with oxygen under superatmospheric pressure at a temperature within the range from about 80° to about 160° C until cellulose pulp is obtained.

2. A process in accordance with claim 1 in which the alkaline compound is selected to allow pulping with oxygen at a pH within the stated range.

3. A process in accordance with claim 2 in which the alkaline compound is selected from the group consisting of alkali metal and alkaline earth metal carbonates, bicarbonates, and hydroxides, and mixtures thereof.

4. A process in accordance with claim 1 in which the amount of alkaline compound is within the range from about 1 to about 10 kilomoles per 1000 kg. of dry lignocellulosic material.

5. A process in accordance with claim 1 in which all of the alkali required for the pulping is added to the lignocellulosic material at the start of the process.

6. A process in accordance with claim 1 in which only a portion of the alkali required is added at the start of the process, and alkali is added to the system thereafter, in amounts to maintain the desired pH.

7. A process in accordance with claim 1, in which the oxygen pulping is preceded by a pretreatment of the lignocellulosic material with an aqueous liquor containing an alkaline compound at a temperature within the range from about 60° to about 200°C, until from about 5 to about 15% of the lignocellulosic material, based on the dry weight of the material, is dissolved in the pretreatment liquor.

8. A process in accordance with claim 7, in which the pH of the pretreatment liquor is within the range from about 6.5 to about 14 during the major portion of the pretreatment time.

9. A process according to claim 7 in which the pretreating liquor contains sodium carbonate, sodium bicarbonate or a mixture thereof, as the alkaline compound, and water or a spent pulping, bleaching or pretreating liquor as the aqueous phase.

10. A process in accordance with claim 7 in which spent pretreating liquor is separated from the lignocellulosic material before the oxygen pulping is begun, by washing out at least a part of the spent pretreating liquor from the pretreated lignocellulosic material with water or a waste oxygen pulping liquor derived from the oxygen pulping process.

11. A process in accordance with claim 1 in which in the first oxygen pulping stage the pH is at about 9 for the major portion, and is then allowed to decrease toward the lower end of the range during the remainder of the pulping time, thereby producing a low viscosity pulp.

12. A process in accordance with claim 1 in which in the first oxygen pulping stage the pH is within the range from about 6.5 to 8 during most of the pulping time, thereby producing a high viscosity pulp.

13. A process in accordance with claim 1 in which during the first oxygen pulping stage, the partial pressure of oxygen is within the range from about 3 to about 200 bars.

14. A process in accordance with claim 1 in which the partial pressure of oxygen during the first oxygen pulping stage is within the ragne from about 8 to about 50 bars, thereby producing a paper pulp.

15. A process in accordance with claim 1 in which the partial pressure of oxygen during the second oxygen pulping stage is within the range from about 1 to about 100 bars.

16. A process in accordance with claim 1, which includes washing first pulping liquor from the partially pulped cellulosic material from the first oxygen pulping stage and then contacting the partially pulped cellulosic material with a second pulping liquor for the second oxygen pulping stage.

17. A process in accordance with claim 16, in which the washing liquor is a spent pulping liquor from the second oxygen pulping stage.

18. A process in accordance with claim 1, in which the pulping is carried out in the presence of a degradation inhibitor which protects the cellulose and hemicellulose molecules against degradation.

19. A process in accordance with claim 18, in which the inhibitor is charged to the pulping liquor at an early stage of the pulping.

20. A process in accordance with claim 18, in which the inhibitor is added to a pretreatment liquor prior to the oxygen pulping.

21. A process in accordance with claim 18, in which the inhibitor is added to the oxygen pulping liquor before combination with lignocellulosic material.

22. A process in accordance with claim 18, in which the inhibitor is a magnesium compound.

23. A process in accordance with claim 1, in which the oxygen is pure oxygen gas.

24. A process in accordance with claim 1, in which the oxygen is in admixture with an inert gas.

25. A process in accordance with claim 1 in which carbon dioxide formed in the oxygen pulping at a pH from about 6 to about 9 is removed.

26. A process in accordance with claim 25 in which such carbon dioxide is absorbed in an alkaline liquid.

27. A process in accordance with claim 1 in which a peroxide is added to the pulping liquor during or at the end of the second oxygen pulping stage.

28. A process in accordance with claim 1 in which the superatmospheric pressure during the second oxygen pulping stage is less than the superatmospheric pressure in the first oxygen pulping stage.

* * * * *